United States Patent [19]

Josso et al.

[11] Patent Number: 4,486,233

[45] Date of Patent: Dec. 4, 1984

[54] NICKEL AND/OR COBALT CHEMICAL PLATING BATH USING A REDUCING AGENT BASED ON BORON OR PHOSPHOROUS

[75] Inventors: Pierre Josso, Issy les Moulineux; Pierre Lepetit, Saint Vrain; Pierre Mazars, Paris, all of France; Marcel J. Massard, deceased, late of Cachan, France, by Yvette L. Massard, heiress

[73] Assignee: Office National d'Etudes et de Recherche Aerospatiales, Chatillon, France

[21] Appl. No.: 518,431

[22] Filed: Jul. 29, 1983

[30] Foreign Application Priority Data

Jul. 30, 1982 [FR] France ..... 82 13431

[51] Int. Cl.[3] ..... C23C 3/02

[52] U.S. Cl. ..... 106/1.22; 106/1.25; 427/438; 427/443.1

[58] Field of Search ..... 106/1.22, 1.25; 427/438

[56] References Cited

U.S. PATENT DOCUMENTS 3,147,154 9/1964 Cole et al. ..... 106/1.22
4,368,223 1/1983 Kobayashi et al. ..... 106/1.22

FOREIGN PATENT DOCUMENTS 2329762 5/1977 France .

*Primary Examiner*—Lorenzo B. Hayes
*Attorney, Agent, or Firm*—Karl F. Ross

[57] ABSTRACT

A nickel and/or cobalt chemical plating bath comprises: a salt of the metal(s) to be deposited; one or more complexing agents of said metal(s), a reducing agent based on boron or phosphorous; and a stabilizing agent. To avoid including sources of corrosion and/or toxic substances in the plating, the stabilizing agent comprises a water soluble organic compound which possesses a readily accessible electron pair, and which does not include any metal or metalloid from group IIIa (other than boron or aluminum), IVa (other than carbon), Va (other than nitrogen or phosphorous), VIa (other than oxygen), or VIIa (other than fluorine or chlorine).

8 Claims, No Drawings

NICKEL AND/OR COBALT CHEMICAL PLATING BATH USING A REDUCING AGENT BASED ON BORON OR PHOSPHOROUS

The present invention relates to a bath for chemically plating a part with nickel and/or cobalt, the bath using a reducing agent based on boron or phosphorous.

BACKGROUND OF THE INVENTION

Nickel, cobalt, and nickel-cobalt plating have been widely used in industry for many years because of the uniformity of plating which can be obtained, regardless of the shape of the part being plated, and regardless of whether the part is made of metal or of plastic.

All the baths currently used for nickel and/or cobalt chemical plating, ie. plating by autocatalysis, regardless of whether the baths are acid or basic, use a reducing agent based on boron or on phosphorous in the form of an alkaline hypophosphite or a hydrogenated boron derivative. In addition to said reducing agent, such baths contain one or more salts of the plating metal(s), one or more complexing agents of said metal(s), and a stabilizing agent.

The complexing agent serves to keep the metal in solution and to liberate metal at the rate at which the plating reaction consumes it. The stabilizing agent is essential for an autocatalysed reaction such as the one used for chemical plating, and serves to reduce the speed of the plating reaction, thereby enabling the desired uniformity of plating to be obtained on the part being plated.

Industrially used stabilizing agents comprise organic and inorganic sulfur derivatives for use in acid baths, and for use in basic baths they comprise compounds of the metals and metalloids from groups IIIa, IVa and Va of the periodic classification of elements, and in particular thallium.

Although baths constituted in this manner are satisfactory for most common applications, the Assignee has encountered difficulties in their use for some specific applications.

The Assignee has been concerned, for example, with the manufacture of metal parts, such as turbine blades, which are required to operate at very high temperatures and in highly corrosive atmospheres, eg. containing sulfur. In this context a surface treatment process has been developed for protecting such parts by chromo-aluminization (see French Pat. No. 74 24694). This thermochemical process is performed on parts previously covered in nickel, and preferably by chemical nickel plating.

Unfortunately, it appears in use, that chemical plating using baths in which the stabilizing agent includes sulfur causes sulfur to be deposited together with the plating metal. The sulfur is deposited at a concentration of 3 to 5 parts per thousand by weight, and may lead to damaging corrosion phenomena in the plating and/or in the plated substrate. Similarly, the use of baths in which the stabilizing agent comprises a compound of a heavy metal such as thallium, leads to the heavy metal being present in the plating. When the heavy metal is at a concentration of about 5% by weight in the plating, it considerably reduces the mechanical properties of the plated alloy by diffusing and/or coalescing in the plating and/or the substrate.

Further, such chemical metal plating techniques are used for plating molds which are used in the manufacture of glass receptacles intended for storing food. Presently used stabilizing agents lead to the presence of toxic material which may diffuse into the glass and thus come into contact with a food product. The Assignee has thus found it desirable to be able to perform chemical nickel and/or cobalt plating using a bath which does not lead to the presence of toxic material in the layer of plating.

Published French patent application No. 2 329 762 proposes a type of stabilizing agent which differs from those usually used in that it is constituted by an organic iodine compound. Such compounds do not avoid the drawbacks of conventional stabilizing agents since the presence of iodine leads to comparable effects to the presence of sulfur. The same is true of other halogens.

Preferred embodiments of the present invention provide a bath for use in nickel and/or cobalt chemical plating, which bath includes a stabilizing agent that does not lead to the above drawbacks associated with prior stabilizing agents.

SUMMARY OF THE INVENTION

The present invention provides a nickel and/or cobalt chemical plating bath comprising: a salt of the metal(s) to be deposited; one or more complexing agents of said metal(s), a reducing agent based on boron or phosphorous; and a stabilizing agent, the improvement wherein the stabilizing agent comprises a water soluble organic compound which possesses a readily accessible electron pair, and which does not include any metal or metalloid from group IIIa (other than boron or aluminum), IVa (other than carbon), Va (other than nitrogen or phosphorous), VIa (other than oxygen), or VIIa (other than fluorine or chlorine).

Boron, aluminum, carbon, nitrogen, phosphorous, oxygen, fluorine and chlorine are acceptable constituents for the stabilizing agent, either because they do not become included in the plating deposit, or because they can be eliminated therefrom, or else because they do not have any toxic or corrosive side effects.

In particular, fluorine and chlorine can be eliminated. If an elimination stage is to be avoided, then the stabilizing agent must not include any metalloid from group VIIa.

By observing the autocatalysis phenomenon in a suitable manner, the inventors have been able to ascertain the properties that are required by stabilizing agents in order to obtain the desired goals.

Their attention was first directed to the electron structure of the plating metal. For example, nickel has a 3d shell which possesses 8 electrons instead of 10, and a 4s shell which possesses 2 electrons and is therefore saturated. To reach a degree of electron stability, nickel tends either to loose its two 4s shell electrons (by oxidizing agent attack to become the cation $Ni^{2+}$) or else to capture two electrons in order to saturate its 3d shell. During chemical plating, the reducing agent tends to oxidize on coming into contact with nickel, while the nickel tends to be reduced. The electrons liberated by oxidizing the reducing agent saturate the nickel's 3d shell, but since it is physically impossible for a nickel anion to exist, the nickel then gives up its excess electrons to the nearest cation, which takes the extra electrons to insert itself in the plating deposit. An electrochemical reaction thus takes place which is catalysed by the plating itself.

The inventors then obseved that it might be advantageous to make use of this property for the purpose of reducing plating activity, and that this could be done by adding a substance having a readily accessible electron pair in order to saturate the 3d shells of the nickel atoms, thereby enabling the substance to be adsorbed on the nickel atoms.

Tests performed by the Applicants on nickel and/or cobalt chemical plating baths in accordance with the invention have given conclusive results.

Suitable compounds meeting this condition include: aromatic heterocyclic compounds having one or more heteroatoms of nitrogen and/or oxygen.

The stabilizing agent may thus be selected from the group constituted by five atom nitrogenous heterocyclic compounds, eg. pyrrole, indole, puride, imidazole, pyrazole, triazole, tetrazole, and similar compounds.

The stabilizing agent could alternatively be chosen from the group constituted by six atom nitrogenous heterocyclic compounds including one or more nitrogen atoms in the cycle, eg. pyridine, cinnoline, pyridazine, pyrimidine, pyrazine, and similar compounds.

Although non-substituted heterocyclic compounds generally give better results, one or more of the carbon atoms in the heterocyclic compounds may be substituted, eg. with a hydrocarbonic radical, an alcohol function radical, carboxylic acid, an ether, an ester, an amine, an aliphatic or aromatic derivative, a halogen atom, or a nitro- or a nitroso-type substituent.

In heterocyclic compounds having a plurality of nitrogen atoms, substituents may be present on one or more of them provided that there remains at least one non-substituted nitrogen atom, since without at least one non-substituted nitrogen atom there will not be a readily accessible electron pair.

The inventors have observed that N-methylpyridinium chloride does not have stabilizing properties and that a chemical plating bath containing this compound decomposes very rapidly, which can be explained by the electron pair becoming masked by the substituent.

Provided that there remains at least one non substituted nitrogen atom, heterocyclic compounds can be used which have at least two adjacent atoms (nitrogen or carbon) bearing substituents that together form an aromatic cycle.

Suitable substituted nitrogenous heterocyclic compounds include nicotinic acid ($\alpha$-pyridinecarboxilic acid), cinnolic acid ($\alpha,\beta$-pyridinedicarboxylic acid), 2-aminoquinoline, riboflavin, and acridine.

Another type of compound suitable for use as a stabilizing agent in a nickel and/or cobalt chemical plating bath in accordance with the invention is constituted by aromatic oxygenated heterocyclic compounds and their substituted derivatives. Suitable examples include five atom heterocyclic compounds such as furan which may be non-substituted or substituted on one or more carbon atoms of the cycle by substituents analogous to those defined above for nitrogenous heterocyclic compounds.

Finally, a third type of compound suitable for use as a stabilizing agent in accordance with the invention is constituted by heavy ethers of the R—O—R′ type which are soluble in water and in which R and R′ represent aliphatic radicals. Suitable heavy ethers include those that have sufficient molecular weight to avoid lowering the bath boiling point below 70° C., which is the lowest operating temperature for most industrial plating baths. In particular, ethers having radicals R and R′ each of which includes at least three carbon atoms are suitable.

Stabilizing agents in accordance with the invention, which do not include any undesirable sulfur, metal or metalloid, are satisfactory for plating alloy parts intended to operate at very high temperatures, or for manufacturing items intended to come into contact with food.

Further, it may be observed that since the type of stabilizing agent defined by the invention acts directly on the plating metal, it may be used regardless of the reducing agent that is employed. However, if the reducing agent is based on boron hydride, eg. an alkali borohydride such as $NaBH_4$ or $KBH_4$, or an aminoborane such as $BH_3$, $R_2NH$ where R is an aliphatic radical, it is still necessary to use a secondary stabilizing agent in order to reduce the activity of the reducing agent, as has been commonly practice in chemical plating baths using primary stabilizing agents based on sulfur or on a heavy metal. Chromium compounds may be used for this purpose in baths which are slightly acid to fairly alkaline, while arsenic compounds may be used for highly alkaline baths. Such secondary stabilizing agents do not leave residues in the metal plating obtained.

Baths in accordance with the invention may include a single compound or a mixture of compounds as the stabilizing agent.

The concentration of the stabilizing agent depends on operating conditions. If the bath contains too little stabilizing agent the bath may decompose spontaneously, while if it contains too much stabilizing agent, the plating speed may drop to practically zero.

For acid baths, the concentration of stabilizing agent lies preferably in the range of about $5.7\times10^{-3}$M to about $6.9\times10^{-3}$M, with a preferred value of about $6.3\times10^{-3}$M.

For alkaline baths, the concentration of stabilizing agent lies preferably in the range of about $2.5\times10^{-4}$M to about $3.5\times10^{-4}$M, with a preferred value of about $3\times10^{-4}$M.

The invention is described in greater detail below with reference to specific examples of baths which are not to be considered as limiting. Concentrations are given as molar concentrations, ie. moles/liter.

Examples are given of slightly acid baths, of slightly alkaline baths, and of alkaline baths, using reducing agents based on boron or on phosphorous.

EXAMPLES

A. SLIGHTLY ACID BATHS: $4.0<pH<7.0$

Example 1

| | | |
|---|---|---|
| Metal salt: | hexahydrated nickel chloride | 0.13 M |
| Complexing agents: | sodium citrate | $4.3\times10^{-2}$ M |
| | sodium succinate | $4.4\times10^{-2}$ M |
| | sodium acetate | $2.4\times10^{-1}$ M |
| Stabilizing agents: | | |
| primary: | pyridine $6.3\times10^{-3}$ M | |
| secondary: | 20 ml of a solution of 0.5 M hexahydrated chromium chloride and 0.7 M of citric acid brought to pH = 6 by adding ammonia, to provide $9\times10^{-3}$ M hexahydrated chromium chloride ($CrCl_3$, $6H_2O$) and $1.4\times10^{-2}$ M citric acid in the bath. | |

The pH was determined using electrometric measurement and its value adjusted to between 5.0 and 5.5 by adding dilute ammonia.

Such a bath may be used in the temperature range 50° C. to 80° C.

It was tested using an aqueous solution of diethylaminoborane as the reducing agent.

A plating speed of about 10 μm/h was obtained for a concentration of diethylaminoborane of 2.5 grams/liter (g/l) at a bath temperature of 70° C.

Example 2

This bath differed from the preceding bath particularly in the complexing agents. Its composition was as follows:

| | | |
|---|---|---|
| Metal salt: | hexahydrated nickel chloride | 0.21 M |
| Complexing agents: | glycolic acid | $3 \times 10^{-4}$ M |
| | lactic acid | $1.6 \times 10^{-4}$ M |
| | succinic acid | $5.5 \times 10^{-2}$ M |
| Stabilizing agents: | | |
| primary: | pyridine | $6.3 \times 10^{-3}$ M |
| secondary: | hexahydrated chromium chloride | $9 \times 10^{-3}$ M |
| | citric acid | $1.4 \times 10^{-2}$ M |

The pH was determined using electrometric measurement and its value adjusted to between 6.0 and 6.5 by adding dilute ammonia.

Such a bath may be used in the temperature range 70° C. to 80° C.

It was tested using an aqueous solution of diethylaminoborane as the reducing agent.

A plating speed of between 10 to 15 μm/h was obtained for a concentration of diethylaminoborane of 4 g/l at a bath temperature of 70° C. to 80° C.

Example 3

A bath identical to the Example 2 bath was prepared, except that hexahydrated cobalt chloride was used at a concentration of 0.2M instead of the hexahydrated nickel chloride.

Such a bath may be used in the temperature range 70° C. to 80° C.

It was tested using an aqueous solution of diethylaminoborane as the reducing agent.

Plating speeds of 10 to 15 μm/h were obtained for bath temperatures of 70° C. to 80° C. respectively when using 4 g/l of diethylaminoborane.

Example 4

A bath identical to the Example 2 bath was prepared, except that a mixture of 0.17M hexahydrated nickel chloride and 0.042M of hexahydrated cobalt chloride was used instead of the hexahydrated nickel chloride on its own.

Such a bath may be used in the temperature range 70° C. to 80° C.

It was tested using an aqueous solution of diethylaminoborane as the reducing agent.

Plating speeds of 10 to 15 μm/h were obtained for bath temperatures of 70° C. to 80° C. repectively when using 4 g/l of diethylaminoborane.

Example 5

This bath used the same type of complexing agent to that used in Example 2:

| | | |
|---|---|---|
| Metal salt: | hexahydrated nickel chloride | 0.12 M |
| Complexing agent: | glycolic acid | 0.5 M |
| Stabilizing agent: | imidazole | $6.8 \times 10^{-3}$ M |

The pH was determined using electrometric measurement and its value adjusted to between 5.8 and 6.2 by adding dilute ammonia.

Such a bath may be used in the temperature range 85° C. to 90° C.

It was tested using an aqueous solution of sodium hypophosphite as the reducing agent.

A plating speed of about 15 μm/h was obtained for a concentration of sodium hypophosphite of 10 g/l at a bath temperature of 88° C.

B. SLIGHTLY ALCALINE BATHS: 7.0<pH<9.0

For these baths, ammonium salts make good complexing agents.

Example 6

| | | |
|---|---|---|
| Metal salt: | hexahydrated nickel chloride | 0.21 M |
| Complexing agents: | succinic acid | 0.3 M |
| | diammonium ammonium | $8.8 \times 10^{-2}$ M |
| Stabilizing agents: | | |
| primary: | pyridine | $6.3 \times 10^{-3}$ M |
| secondary: | hexahydrated chromium chloride | $1 \times 10^{-3}$ M |
| | citric acid | $1.4 \times 10^{-2}$ M |

The pH was determined using electrometric measurement and its value adjusted to between 7.0 and 8.0 by adding dilute ammonia.

The bath was used in the temperature range 50° C. to 70° C.

It was tested using an aqueous solution of dimethylaminoborane as the reducing agent.

A plating speed of between 5 to 10 μm/h was obtained for a concentration of reducing agent of 4 g/l and with the bath at temperatures in the range 50° C. to 70° C.

Example 7

| | | |
|---|---|---|
| Metal salt: | hexahydrated nickel chloride | 0.12 M |
| Complexing agents: | trisodium sodium citrate | 0.35 M |
| | ammonium chloride | 1 M |
| Stabilizing agent: | imidazole | $6.8 \times 10^{-3}$ M |

The pH was determined using electrometric measurement and its value adjusted to between 8.9 and 9.5 by adding concentrated ammonia.

The bath may be used in the temperature range 85° C. to 90° C.

It was tested using an aqueous solution of sodium hypophosphite as the reducing agent.

A plating speed of about 15 μm/h was obtained for a concentration of reducing agent of 10 g/l and with the bath at a temperature of 88° C.

Example 8

| | | |
|---|---|---|
| Metal salt: | hexahydrated cobalt chloride | 0.12 M |
| Complexing agents: | trisodium sodium citrate | 0.35 M |
| | ammonium chloride | 1 M |
| Stabilizing agent: | imidazole | $6.8 \times 10^{-3}$ M |

The pH was determined using electrometric measurement and its value adjusted to between 8.9 and 9.5 by adding concentrated ammonia.

The bath may be used in the temperature range 85° C. to 90° C.

It was tested using an aqueous solution of sodium hypophosphite as the reducing agent.

A plating speed of about 15 μm/h was obtained for a concentration of reducing agent of 10 g/l and with the bath at a temperature of 93° C.

C. HIGHLY ALCALINE BATHS: pH>9.0

Example 9

| | | |
|---|---|---|
| Metal salt: | hexahydrated nickel chloride | 0.13 M |
| Complexing agent: | ethylenediamine | 1 M |
| Stabilizing agents: | | |
| primary: | imidazole | $2.9 \times 10^{-4}$ M |
| secondary: | arsenic acid | $4.4 \times 10^{-3}$ M |

A 1M solution of caustic soda was used to bring the pH up to a suitable value in the range 13 to 14.

The bath was maintained in the temperature range 92° C. to 95° C.

It was tested using an aqueous solution of sodium borohydride as the reducing agent.

A plating speed of between 15 and 20 μm/h was obtained for a concentration of reducing agent of 0.5 g/l and with the bath in said temperature range.

Example 10

A bath identical to that used in Example 9 was prepared, except that $2.9\times10^{-4}$M of furfuryl alcohol was used the primary stabilizing agent instead of imidazole.

The bath was maintained in the temperature range 92° C. to 95° C.

It was tested using an aqueous solution of sodium borohydride as the reducing agent.

A plating speed of between 5 and 10 μm/h was obtained for a concentration of reducing agent of 0.5 g/l and with the bath in said temperature range.

We claim:

1. In a chemical plating bath for the autocatalytic plating of nickel or cobalt, wherein the plating bath comprises a salt of the metal to be deposited, at least one complexing agent to keep the metal in solution and to liberate the metal at the rate at which the plating reaction consumes it, a reducing agent containing a boron or phosphorus compound, and a stabilizing agent; the improvement which comprises a water-soluble stabilizing agent selected from the group consisting of pyridine, cinnoline, nicotinic acid, cinnolic acid, 2-aminoquinoline, riboflavine, acridine, indole, pyrrole, furan and an ether of the formula $$R—O—R^1$$

wherein R and $R^1$ each represent an aliphatic radical having at least 3 carbon atoms.

2. The bath according to claim 1 wherein the water-soluble stabilizing agent is pyridine.

3. The bath according to claim 1 wherein the water-soluble stabilizing agent is the aliphatic ether.

4. The bath according to claim 1 wherein the bath includes a mixture of several stabilizing agents.

5. The bath according to claim 1, wherein the bath is acid, and wherein the molar concentration of stabilizing agent lies in the range of about $5.7\times10^{-3}$M to about $6.9\times10^{-3}$M.

6. The bath according to claim 1 wherein the bath is acid, and wherein the molar concentration of stabilizing agent is about $6.3\times10^{-3}$M.

7. The bath according to claim 1 wherein the bath is alkaline, and where the molar concentration of stabilizing agent lies in the range of about $2.5\times10^{-4}$M to about $3.5\times10^{-4}$M.

8. The bath according to claim 1 wherein the bath is alkaline, and wherein the molar concentration of stabilizing agent is about $3\times10^{-4}$M.

* * * * *